US006220052B1

(12) United States Patent
Tate, Jr. et al.

(10) Patent No.: US 6,220,052 B1
(45) Date of Patent: Apr. 24, 2001

(54) APPARATUS AND METHOD FOR LIQUEFYING NATURAL GAS FOR VEHICULAR USE

(75) Inventors: Raymond E. Tate, Jr., Felton; Harold M. Lee, Los Gatos, both of CA (US)

(73) Assignee: Liberty Fuels, Inc., Watsonville, CA (US)

( * ) Notice: Subject to any disclaimer, the term of this patent is extended or adjusted under 35 U.S.C. 154(b) by 0 days.

(21) Appl. No.: 09/375,663

(22) Filed: Aug. 17, 1999

(51) Int. Cl.[7] ..... F25J 1/00; F25B 19/02
(52) U.S. Cl. ..... 62/613; 62/51.2
(58) Field of Search ..... 62/611, 613, 908, 62/51.2, 619

(56) References Cited

U.S. PATENT DOCUMENTS

| | | | | |
|---|---|---|---|---|
| 3,894,856 | * | 7/1975 | Lofredo et al. | 62/908 |
| 4,319,900 | * | 3/1982 | Gram | 62/908 |
| 5,009,073 | * | 4/1991 | Missimer et al. | 62/51.1 |
| 5,327,730 | * | 7/1994 | Myers et al. | 62/613 |
| 5,386,699 | | 2/1995 | Myers et al. | 62/9 |

FOREIGN PATENT DOCUMENTS

| | | | | |
|---|---|---|---|---|
| 2069119 | * | 8/1981 | (GB) | 62/611 |

* cited by examiner

*Primary Examiner*—William Doerrler
(74) *Attorney, Agent, or Firm*—Flehr Hohbach Test Albritton & Herbert LLP

(57) ABSTRACT

Apparatus for liquefying natural gas supplied from a source comprising a compressor for compressing the natural gas. A chiller reduces the temperature of the compressed gas, a heat exchanger for further cooling the cooled compressed gas. A Joule-Thompson valve is provided having an inlet and an orifice in communication with the inlet and the dewar for changing the size of the orifice. A pipe is connected from the heat exchanger to the Joule-Thompson valve and supplies cooled compressed gas to the inlet of the Joule-Thompson valve. The inlet of the Joule-Thompson valve has an inlet pressure. The dewar has a pressure therein substantially less than the pressure in the inlet whereby when the cooled compressed gas from the inlet piping passes through the Joule-Thompson valve there is an expansion of the gas to provide further cooling and liquefaction of a substantial portion of the gas as it passes into the dewar. A controller is coupled to the needle valve for adjusting the position of the needle valve with respect to the orifice to thereby adjust the size of the orifice to maintain a substantially constant pressure of the cooled compressed gas in the inlet to the Joule-Thompson valve to thereby provide a controlled expansion of the cooled compressed natural gas from a high pressure to the lower pressure in the dewar.

29 Claims, 8 Drawing Sheets

APPARATUS AND METHOD FOR LIQUEFYING NATURAL GAS FOR VEHICULAR USE

This invention relates to an apparatus and method for liquefying natural gas for vehicular use.

A method and apparatus for liquefying natural gas for a fuel for vehicles and a fuel tank for use therewith is disclosed in U.S. Pat. No. 5,327,730 issued on Jul. 12, 1994. In connection with the method and apparatus therein disclosed, difficulties have been encountered in reducing the pressure of natural gas being supplied through a fixed orifice because of changes in temperature of the natural gas. Additional difficulties have been encountered because of freezing of carbon dioxide in the natural gas. There is therefore a need for a new and improved apparatus and method for liquefying natural gas, particularly for vehicular use.

In general, it is an object of the present invention to provide an apparatus and method for liquefying natural gas for vehicular use which substantially increases the proportion of natural gas becoming a liquid during each cycle.

Another object of the invention is to provide an apparatus and method of the above character in which carbon dioxide in the natural gas is removed before liquefaction of the natural gas.

Another object of the invention is to provide an apparatus and method of the above character in which an adjustable orifice is provided in the Joule-Thompson valve to accommodate different temperatures of the incoming natural gas by maintaining a constant inlet pressure.

Another object of the invention is to provide an apparatus and method of the above character which by controlling the pressure of the compressed gas makes it possible to operate at very high liquefaction efficiencies.

Another object of the invention is to provide an apparatus and method of the above character in which the Joule-Thompson valve utilized is mounted in an assembly directly mounted on the dewar which can accommodate expansion and contraction in the dewar on which it is mounted.

Another object of the invention is to provide an apparatus and method of the above character in which all of the piping for the dewar is provided through the Joule-Thompson valve assembly for reducing the cost of the dewar.

Another object of the invention is to provide an apparatus and method of the above character which does not require the use of a cryogenic pump to transfer liquefied natural gas from the dispenser.

Another object of the invention is to provide an apparatus and method of the above character which does not require the use of a cryogenic pump to transfer liquefied natural gas from the dispenser.

Additional objects and features of the invention will appear from the following description in which the preferred embodiments are set forth in detail in conjunction with the accompanying drawings.

Figure 1:
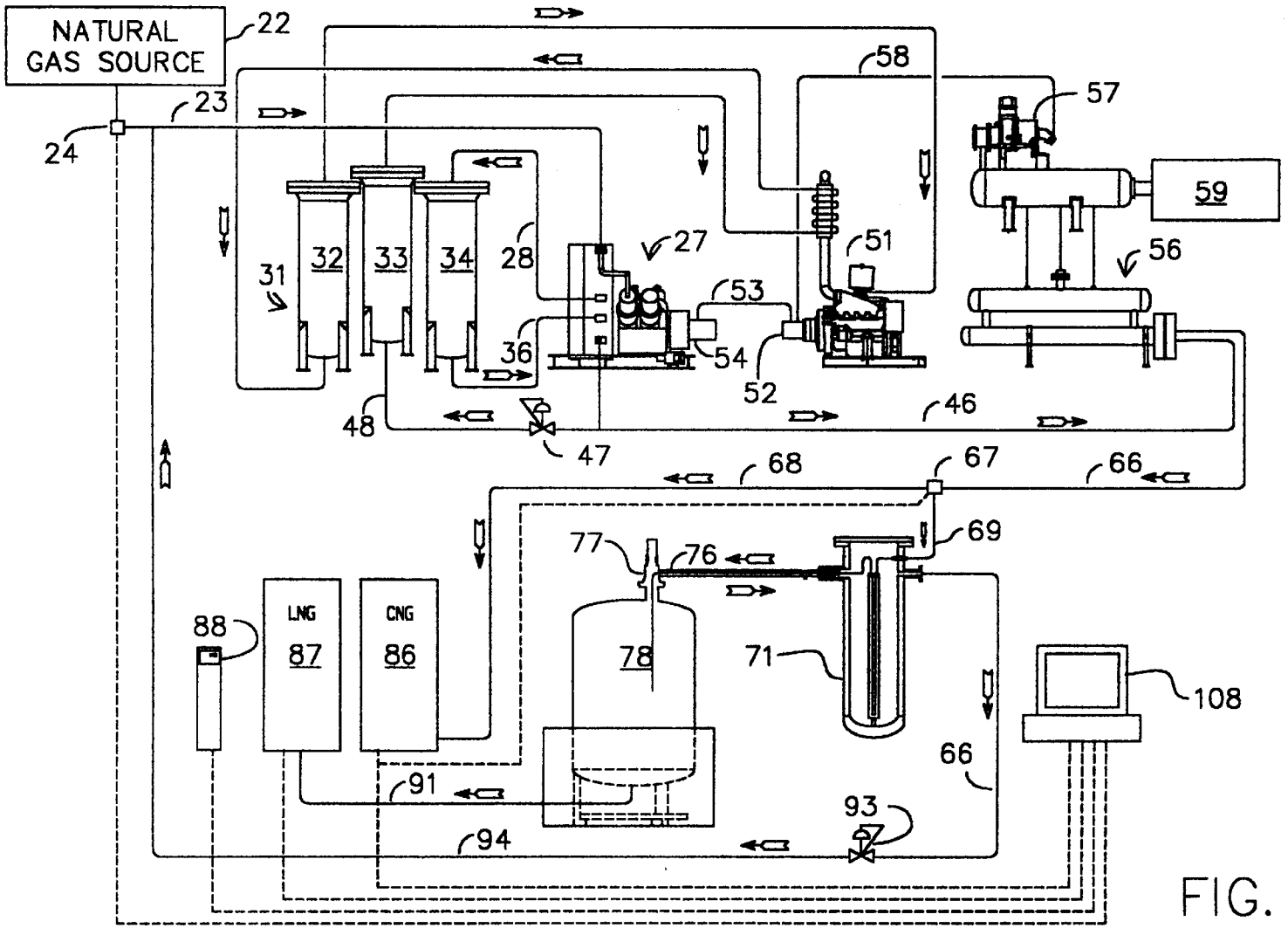
FIG. 1 is a schematic representation of the apparatus of the present invention and the flow diagram for use therewith.

In general, the apparatus for liquefying natural gas includes means for removing the carbon dioxide from the natural gas. A compressor is provided for compressing the natural gas. A chiller is provided for reducing the temperature of the compressed gas. A heat exchanger is provided for further cooling of the compressed gas. A dewar is provided. A Joule-Thompson valve assembly is provided which is mounted on the dewar and has an orifice with an adjustable needle valve for controlling the size of the orifice for maintaining a constant pressure of the natural gas ahead of the Joule-Thompson valve to provide a controlled expansion of the gas from a high pressure to a lower pressure in the dewar to thereby cause liquefaction of a substantial portion of the gas.

More in particular as shown in the drawings the apparatus 21 for liquefying natural gas is for on-site natural gas liquefaction for dispensing compressed natural gas or liquid natural gas at a site accessible by the vehicles. The apparatus 21 is to be used with a source 22 of natural gas available at the site. The natural gas typically available at such a site has components which include methane and the heavier hydrocarbons. The heavier hydrocarbons are ethane, propane, butane, pentane, etc. Also included are inerts such as nitrogen, carbon dioxide and water. Methane which is the principal component of natural gas is only a liquid at an extremely cold temperature and within a certain pressure range. At atmospheric pressure, methane is a liquid at −260° F. (−160° C.)

The apparatus 21 uses such natural gas from the source 22 which supplies the gas to piping 23 connected to the first stage 26 of a four stage compressor 27 (see FIGS. 1 and 8) through a pneumatic control valve 24 and a check valve 25. The gas after passing to the first stage 26 passes through piping 28 through a multi-tower regenerating molecular sieve bed 31 of the type hereinafter described in more detail consisting of three desiccant vessels or towers 32, 33 and 34 also respectively identified as DF1, DF2 and DF3 which are disposed in close proximity to each other and interconnected by valving hereinafter described. Briefly, one tower is used for absorbing the contaminants while the other two towers are being regenerated with the second tower being in a heating cycle and the third tower being in a cool-down mode. As hereinafter explained, the molecular sieve bed 31 is utilized for removing water and carbon dioxide. The water and the carbon dioxide are removed to prevent clogging of the processing equipment utilized in the apparatus 21 since water and the carbon dioxide solidify at the low temperature encountered during processing of the natural gas in the apparatus 21.

After the undesired substances such as water and carbon dioxide have been removed from the natural gas, the natural gas is connected by piping 36 to the second stage 37 of the compressor 27. Piping 38 (FIG. 8) connects the second stage 37 to the third stage 39 and piping 41 connects the third stage 39 to the fourth stage 42. After passing through these four stages of compression, the natural gas has been compressed to a suitable pressure as for example approximately 2200 to 3000 psi and preferably 2700 to 2800 psi and supplied to piping 46 which is connected to a pressure reducing regulator 47 to reduce the pressure to approximately 150 psi. This compressed gas from regulator 47 is delivered by piping 48 to the desiccant tower 33.

The four-stage compressor 27 is driven in a suitable matter as for example by a natural gas internal combustion engine 51 which drives hydraulic fluid pumps 52. The hydraulic fluid from one of the pumps 52 is supplied through piping 53 to a hydraulic motor 54 that drives the four-stage compressor 27. The hydraulic pumps 52 also include two additional hydraulic pumps (not shown) that drive other accessories including fans (not shown).

The compressed gas from the compressor 27 through the piping 46 is supplied to an industrial type gas chiller 56 using a mechanical refrigerant. As is well-known to those skilled in the art, the chiller 56 includes a compressor 57 which is driven by hydraulic fluid supplied on piping 58 from one of the hydraulic pumps 52. The chiller 56 also includes an evaporator heat exchanger 59. The gas in the chiller 56 is cooled to a suitable temperature as for example −60° F. and is supplied through outlet piping 66 at approximately this temperature to a pneumatic control valve 67 which is connected to piping 68 to a dispenser hereinafter described and is supplied by piping 68 through desiccant vessel 33 to the fuel intake of the internal combustion engine 51 as hereinafter described. The remaining compressed gas is then supplied through piping 69 to a main methane-to-methane countercurrent heat exchanger 71 which reduces the temperature of the compressed gas to approximately −100° F.

The cooled compressed gas after being cooled to −100° F. is supplied through tri-axial piping 76 to a Joule-Thompson (JT) valve assembly 77 mounted on top of a dewar or cryogenic liquid methane storage vessel 78. As hereinafter explained, the JT valve assembly 77 is computer controlled to provide relatively high liquefaction efficiencies over a fluctuating range of temperatures and pressures. The gas in passing through the JT valve assembly 77 is expanded to a pressure of 90–125 psig under a method which uses a closed loop system identifying temperatures and pressures and properly controlling the orifice in the JT valve assembly as hereinafter described. Typically approximately 50% of the flow across the orifice of the JT valve assembly 77 is liquefied with the remaining 50%, still a gas being very cold in the range of −180° F. is withdrawn from the dewar 78 and is withdrawn through the tri-axial piping 76 and supplied to the return cooled gas countercurrent heat exchanger 71. This cold countercurrent gas reduces the temperature of the feed stock natural gas from −60° F. −100° F.

Although liquefaction of natural gas can be achieved at pressures as low as 681 psig, the most effective pressure to liquefy natural gas for small scale on-site liquefaction as in the present apparatus 21 appears to be between 2700 psig and 3000 psig. There is a lower efficiency in the apparatus beyond 3100 psig which means that the energy spent for compression over 3000 psig yields very little if any increase to the liquefaction rate as can be ascertained from the entropy chart for natural gas.

As shown in FIG. 1, the apparatus 21 includes a compressed natural gas dispenser 86 and a liquid natural gas dispenser 87 under the control of a card lock apparatus 88 for use in dispensing the desired fuel to a vehicle 89 (see FIG. 8) having access to the apparatus 21 at the site. Piping 91 is provided for connecting the liquid natural gas in the dewar 78 to the liquid natural gas dispenser 87. Compressed gas which has not been liquefied is returned from the countercurrent heat exchanger 71 through piping 92 through a pressure reducing regulator 93 and then through piping 94 through a check valve 95 (FIG. 8) to the piping 22 for reprocessing in the apparatus 21.

A fuel nozzle 101 of the type disclosed in co-pending application Ser. No. 09/375,662 filed Aug. 17, 1999 (A-68329) is provided for supplying liquefied natural gas to a fuel tank 102 on the vehicle 89. The nozzle 101 includes a liquefied gas line 103 and a vent return line 104 which are connected through a tri-axial line 106 to the dispenser 87. Since the vent return line 104 is included in the nozzle 101, the vent return line is coupled to the piping 23 through a check valve 105 when the vale 24 is closed under the control of the nozzle 101 when operated to cause gas vapors to be removed from the tank 102. Removal of gas vapor from the tank 102 causes a reduction in pressure in tank 102 which causes LNG to flow from the dewar 78 through the nozzle 101 into the tank 102 until delivery is terminated or when the tank is full. Such a method eliminates the need for an expensive cryogenic pump.

In connection with the apparatus 21, a data acquisition, communication, computer management system 108 (FIG. 1) is provided which is connected to various sensors (not shown) and controls (not shown) for controlling the operation of the apparatus 21 as hereinafter described in more detail.

The construction of the JT valve assembly 77 and its mounting on the dewar 78 may now be described more in detail. The dewar 78 is comprised of an inner stainless steel tank 111 and an outer carbon steel tank 112 with a space 113 therebetween which is provided with superinsulation (not shown) and a vacuum. The inner stainless steel tank 111 when it gets colder will shrink with respect to the carbon steel tank 112 which contraction must be accommodated by a weld-neck flange assembly 116 mounted on the dewar 78. The weld-neck flange assembly 116 consists of weld-neck flange 117 which is mounted in an opening 118 in the outer tank 112 and an opening 119 in general registration with the opening 118 in the inner tank 111. A cylindrical pipe 121 has its lower extremity welded to the inner tank 111 in the opening 119 and extends upwardly through the opening 118 in the outer tank 112 and is welded to the lower extremity of the weld-neck flange 117. A bellows 122 is provided which has its upper extremity welded to the weld-neck flange 117 and has its lower extremity welded to the outer tank 112 at the opening 118. Thus, the bellows 122 serves to permit expansion and contraction of the inner tank 111 with respect to the outer tank 112 and to maintain an air-tight and liquid-tight seal between the flange 117 and the outer tank 112 and the inner tank 111.

Figure 2:
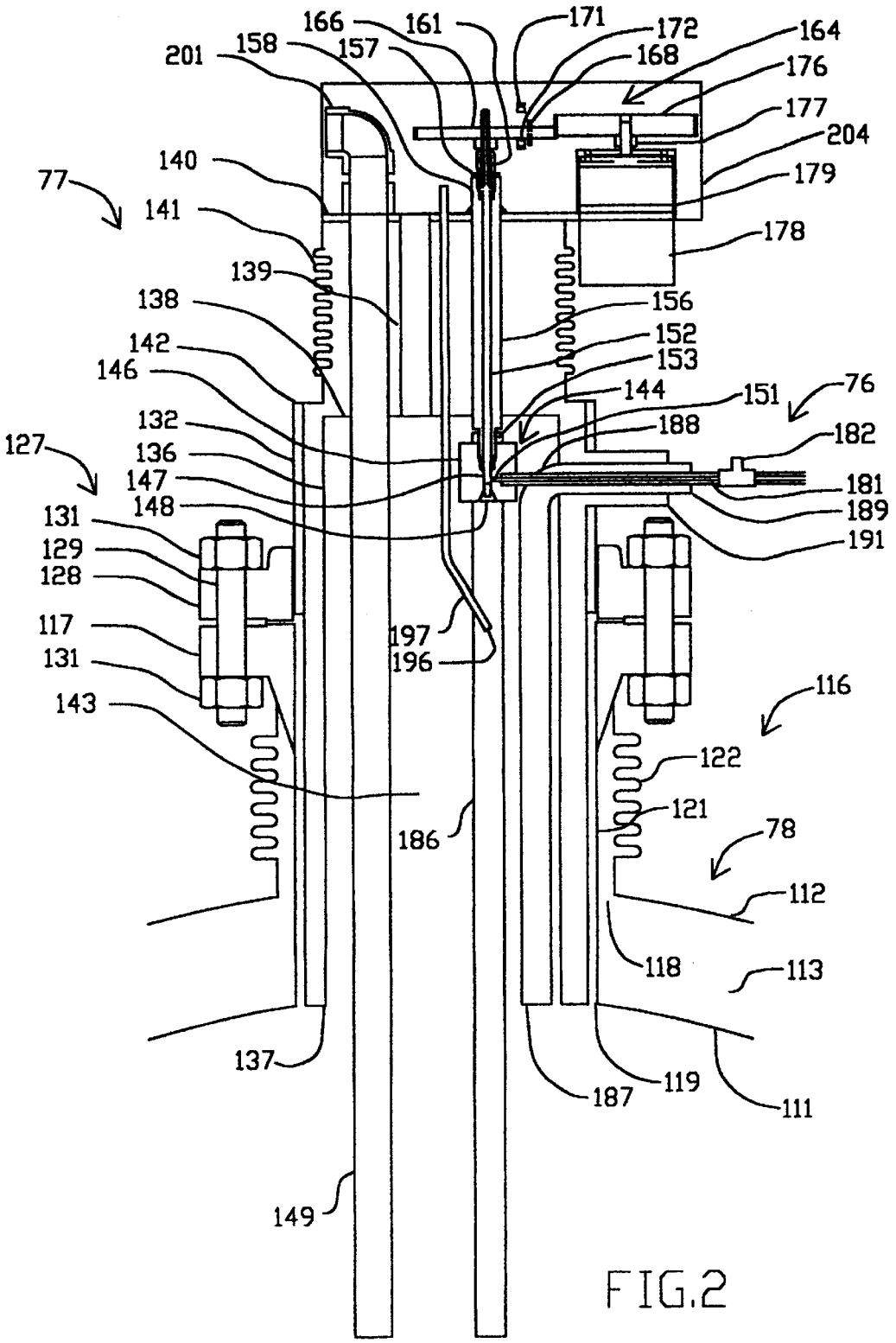
FIG. 2 is a partial cross-sectional view of the cryogenic liquid methane storage vessel shown in FIG. 1 with the Joule-Thompson valve of the present invention mounted thereon.

A cylindrical sleeve 126 of a suitable material such as stainless steel is welded to the pipe 121 and extends upwardly through the weld-neck flange 117 as shown in FIG. 2 and forms a slip fit with respect to a slip-on flange assembly 127.

A slip-on flange assembly 127 is provided consists of a slip-on flange 128 which is removably secured to the weld-neck flange 117 by circumferentially spaced-apart threaded rods 129 with nuts 131 secured to opposite ends thereof. A pipe 132 is welded to the slip-on flange 128 and extends upwardly therefrom and forms a part of the JT valve assembly 77.

The JT valve assembly 77 also includes an inner cylindrical member 136, the lower extremity of which is welded to an annulus 137 which is welded to the lower extremity of the sleeve 126. The inner cylindrical member 136 extends upwardly in the pipe 132 and is provided with a top cover plate 138 which is welded to the top of the inner cylindrical member 136. A dip slide tube 139 is mounted on the top cover plate 138 and extends upwardly therefrom and has a support plate 140 mounted thereon. The tube 139 houses an electronic dipstick (not shown). A bellows 141 is connected between the support plate 140 and the upward extremity of the pipe 132 by an annulus 142. The bellows 141 serves to permit contraction and expansion of the inner tank 111 with respect to the outer tank 112 and provides a liquid-tight connection between the plate 142 and the pipe 132. The JT valve assembly 77 thus provides a manway 143 in the form of a cylindrical passage into the inner tank 111.

The JT valve assembly 77 includes a JT valve 144 that has a body 146 mounted within the manway 143 in the inner cylindrical member 136 and is supported by the top cover plate 138. The valve body 146 is provided with a flow passage 147 therein which opens into an orifice 148. The flow passage 147 is also in communication with an inlet flow passage 151 extending at right angles to the flow passage 147. A needle valve 152 extends into the orifice 148 for adjusting the size of the orifice 148 as hereinafter described. The needle valve 152 passes through a packing nut 153 provided on the valve body 146 and extends upwardly through the top cover 138 through a needle valve enclosure 156 that also extends through the support plate 142. The needle valve 152 is adjustable axially by threads 157 in the valve body 146 engaging mating threads 158 on the stem of the needle valve 152. A shroud 161 is provided at the upper extremity of the needle valve 152 and accommodates movement of the needle valve between open and closed positions with respect to the orifice 148.

Needle valve drive means 164 is provided for the needle valve 152 and includes a spur gear 166 mounted on the upper end of the needle valve 152 and which moves with the needle valve 152 as it is moved between open and closed positions with respect to the orifice 148. The spur gear 166 is provided with a pin 168 which extends therethrough and which is adapted to pass through slotted infrared sensor housings 171 and 172 mounted in fixed positions on opposite sides of the gear. The pin 168 actuates the infrared sensor in the sensor housing 171 when the needle valve 152 is in a fully open position with respect to the orifice 148 and conversely the pin 168 actuates the infrared sensor in the sensor housing 172 when the needle valve 153 is in a fully closed position with respect to the orifice 148. The needle valve drive means 164 also includes a spur gear 176 that drives spur gear 166. Spur gear 176 is mounted on the output shaft 177 of a stepper motor 178 carried by a bracket 179 on the mounting plate 140. The stepper motor 178 is a high resolution stepper motor as for example one having 12,800 steps per revolution to make it possible to precisely control the movement of the needle valve 152 with respect to the orifice 148.

The needle valve 152 and the orifice 148 have been selected so that the JT valve 144 is an eleven-turn valve. Thus, when the pin 168 interrupts the infrared beam in the sensor housing 172, the JT valve 144 is in a closed or home position. After eleven turns the JT valve 144 is moved from the closed position to an open position.

As hereinbefore explained, the cold compressed gas is supplied to the JT valve assembly 77 through tri-axial piping 76. As shown in FIG. 2, this tri-axial piping 76 includes an inner pipe 181 which supplies this cooled and compressed gas to the inlet flow passage 151 and into the orifice 148. A pressure sensor 182 is provided in the inner pipe 181 and is connected to the computer 106.

With the cooled compressed gas being delivered to the inlet flow passage at a pressure of typically between 2700 and 2800 psi as it expands through the orifice 148, a large proportion of the gas as for example 50% or greater is liquefied and passes through a pipe 186 welded to the valve body 146 and extending down into the upper portion of the inner tank 111 of the dewar 78 that contains the liquefied natural gas. At the same time the portion of the cooled compressed gas which is not liquefied passes down through the pipe 186 into the upper part of the inner tank 111 and is returned from through a pipe 187, also a part of the JT valve assembly 77. The pipe 187 is connected by a 90° elbow 188 to an outer pipe 189 that is concentric with the inner pipe 181 and which forms a part of the tri-axial piping 76 hereinbefore described. Thus this cold returned gas is returned to the countercurrent heat exchanger 71 to aid in cooling of the incoming natural gas being supplied to the heat exchanger 71. An outer annulus 191 is provided as a part of the tri-axial piping 76 and typically is under a vacuum to provide the desired insulation for the cold gas passing through the outer pipe 189. The outer pipe 189 also serves to insulate the pipe 181.

Figure 3:
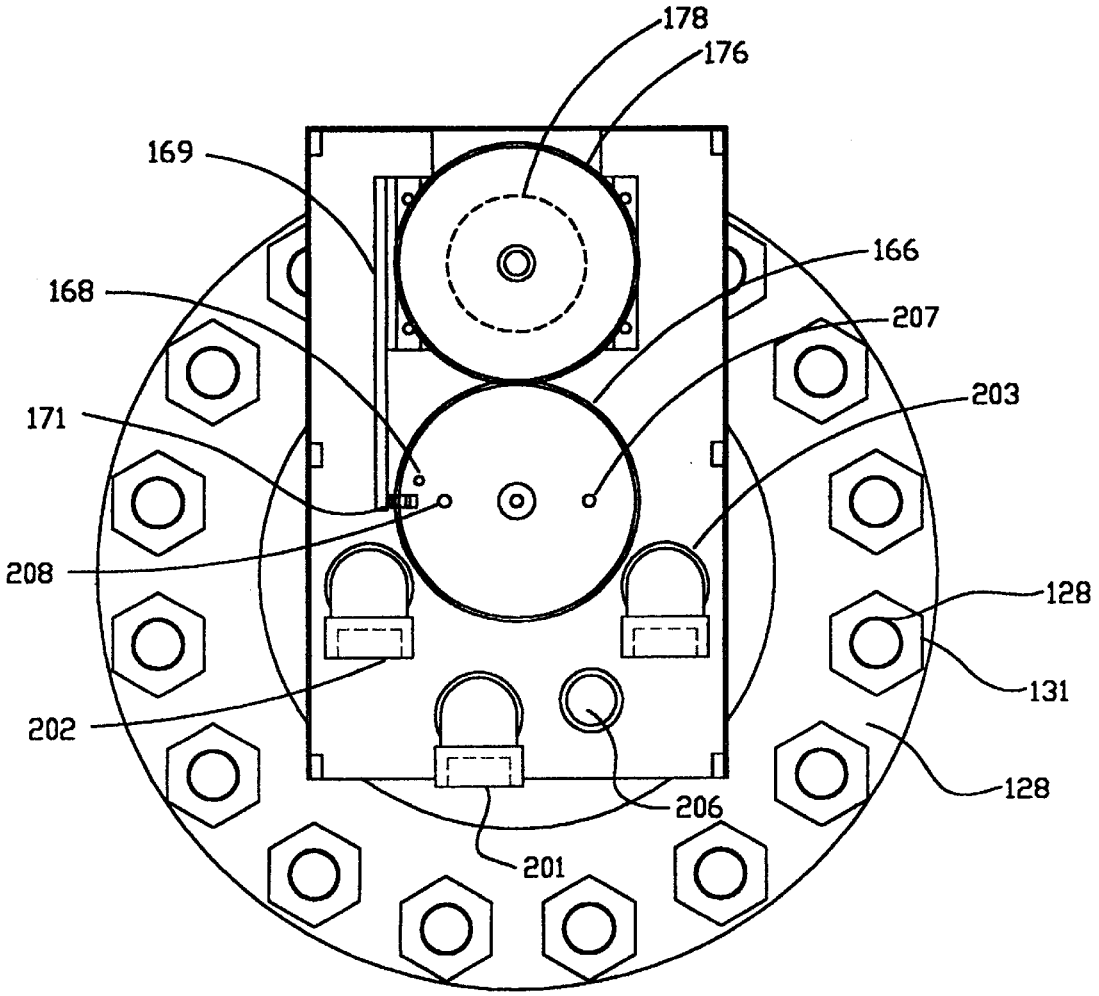
FIG. 3 is a top plan view of the Joule-Thompson valve shown in FIG. 2.

A temperature sensor 196 is provided in the pipe 186 for sensing the temperature of the liquefied natural gas passing through the pipe 186 down into the dewar 78. Conductive wires (not shown) are connected to the computer 106 through a tube 197 forming a part of the JT valve assembly 77. A fill pipe 199 is provided as a part of the JT valve assembly 77 and extends upwardly through the support plates 138 and 140 and is connected to an elbow 201 to which a connection can be made from the exterior of the JT valve assembly 77 for supplying liquefied natural gas through the pipe 191 to the top of the dewar 78. In addition as shown in FIG. 3 there is provided a vent pipe 202 and a pressure relief vent 203. There is also provided a radio frequency level sensor 206. A fitting 207 is provided for the temperature sensor 196 and a fitting 208 for the pressure sensor 182. A housing 204 is mounted on the support plate 140 and encloses the drive means 164. The operation of this JT valve assembly in conjunction with the apparatus 21 will hereinafter be described more in detail.

Figure 4:
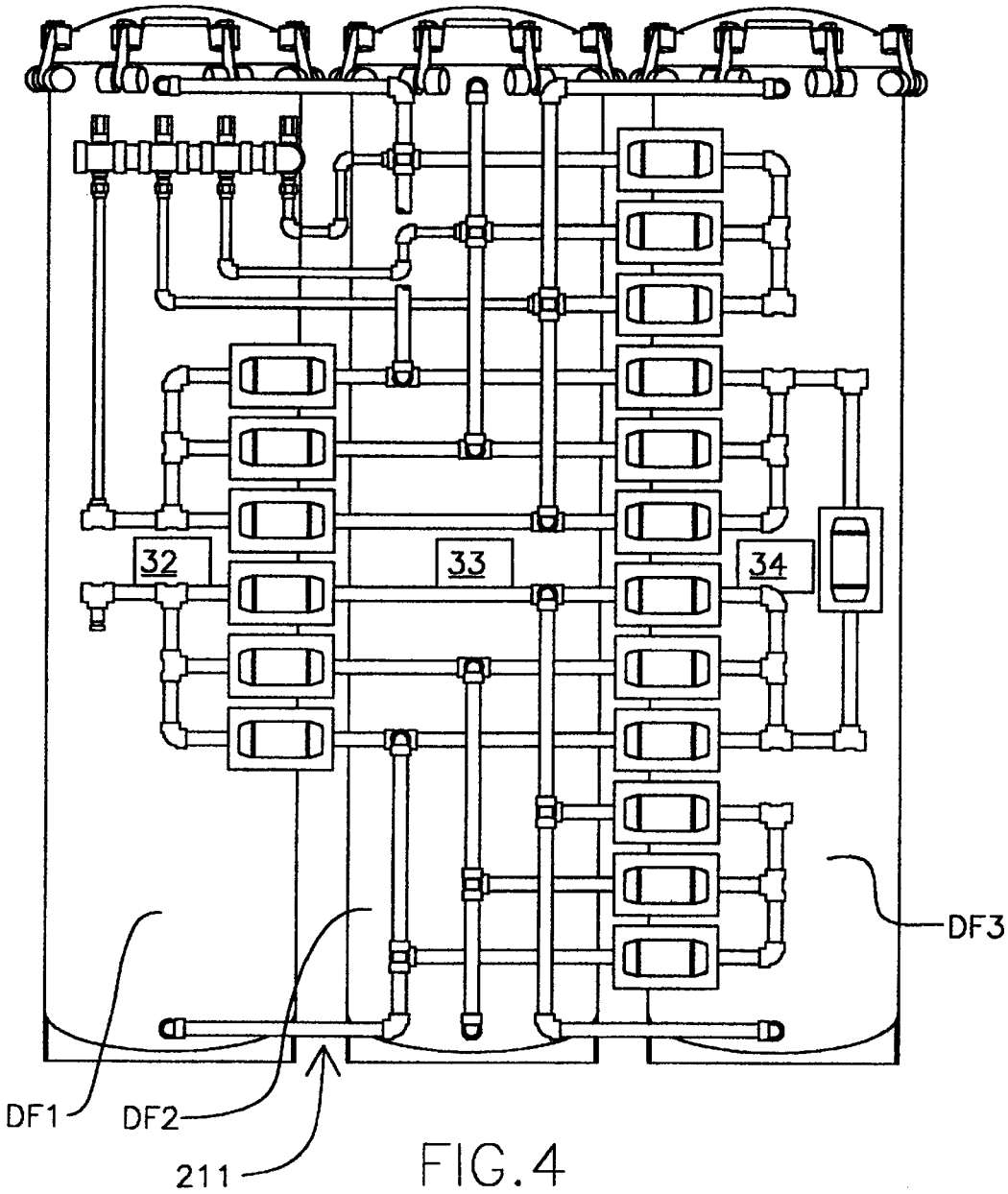
FIG. 4 is side elevational view of the tri-tower regenerating molecular sieve bed shown in FIG. 1.
Figure 5:
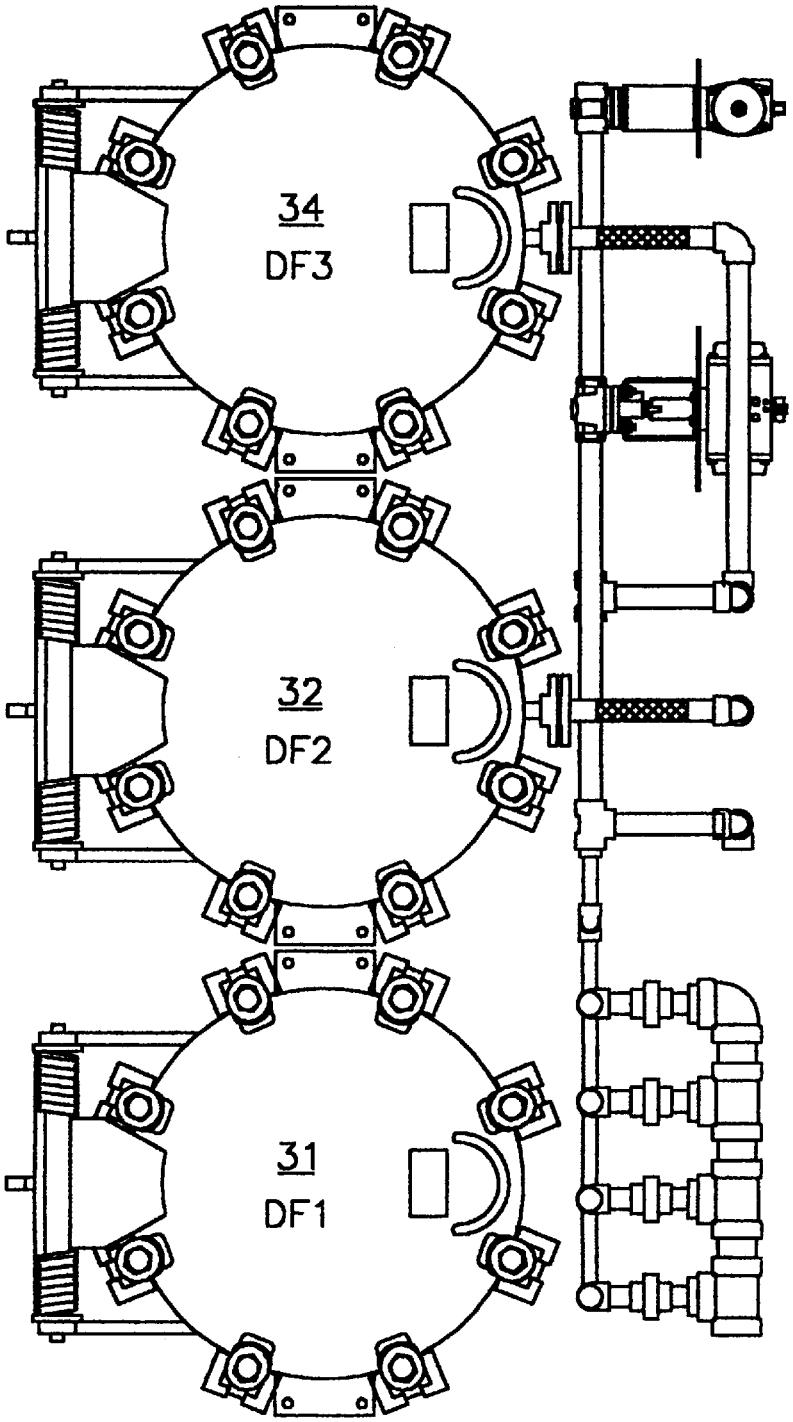
FIG. 5 is a top plan view of the molecular sieve bed shown in FIG. 4.
Figure 6:
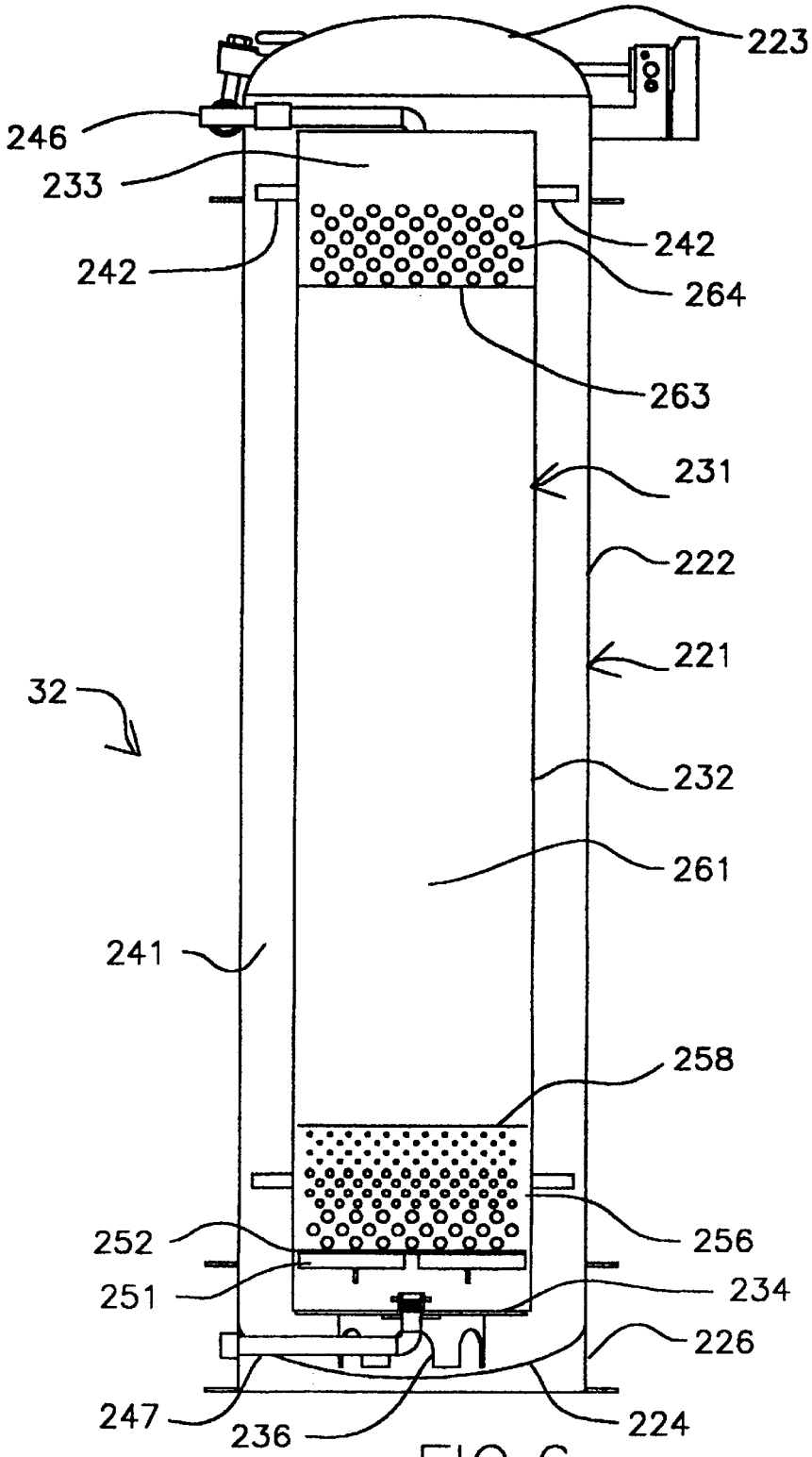
FIG. 6 is a cross-sectional view of one of the desiccant vessels shown in FIG. 4 and taken along the line 6—6 of FIG. 4.
Figure 7:
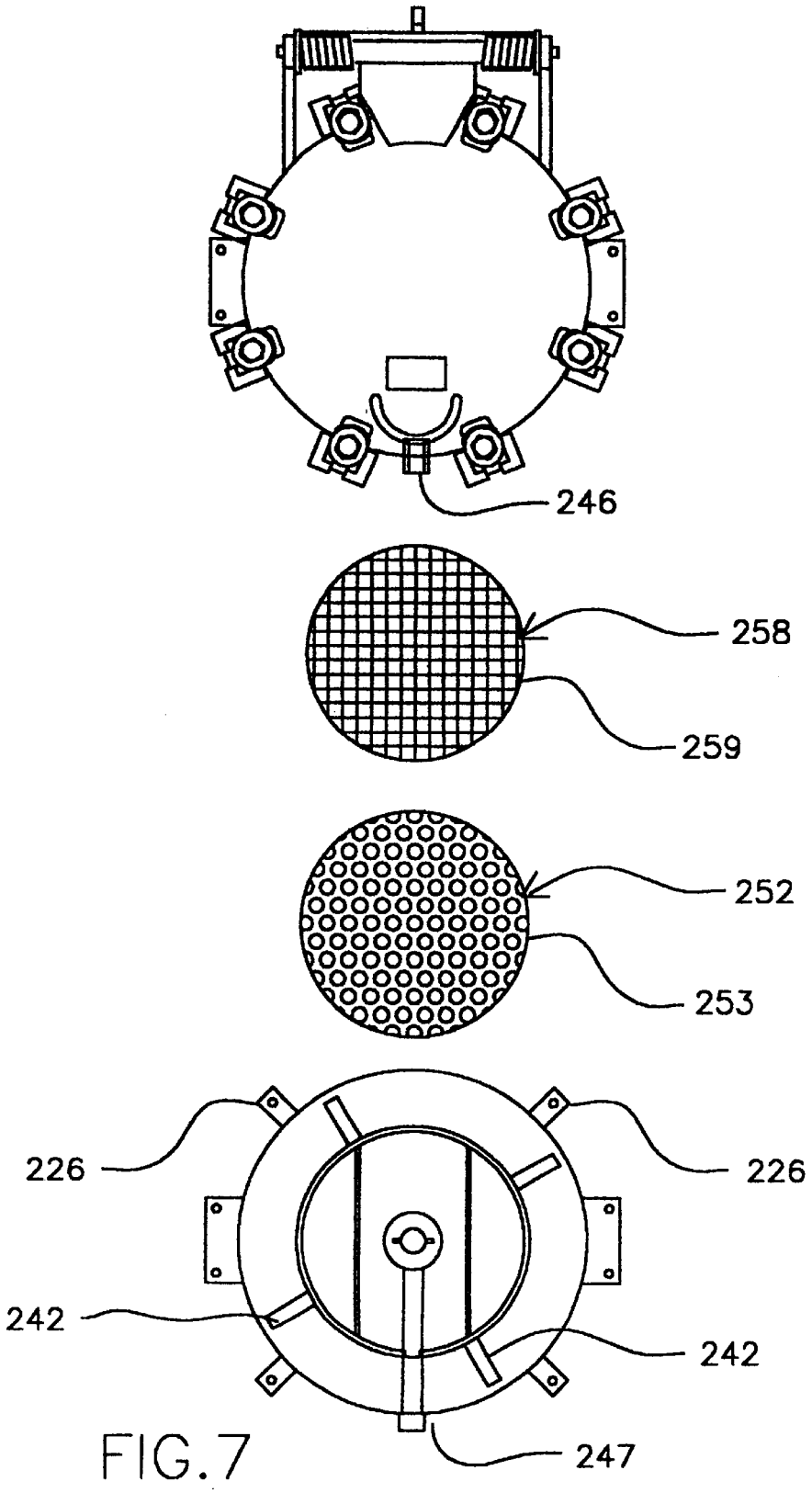
FIG. 7 is an exploded view of the desiccant vessel as shown in FIG. 6.
Figure 8:
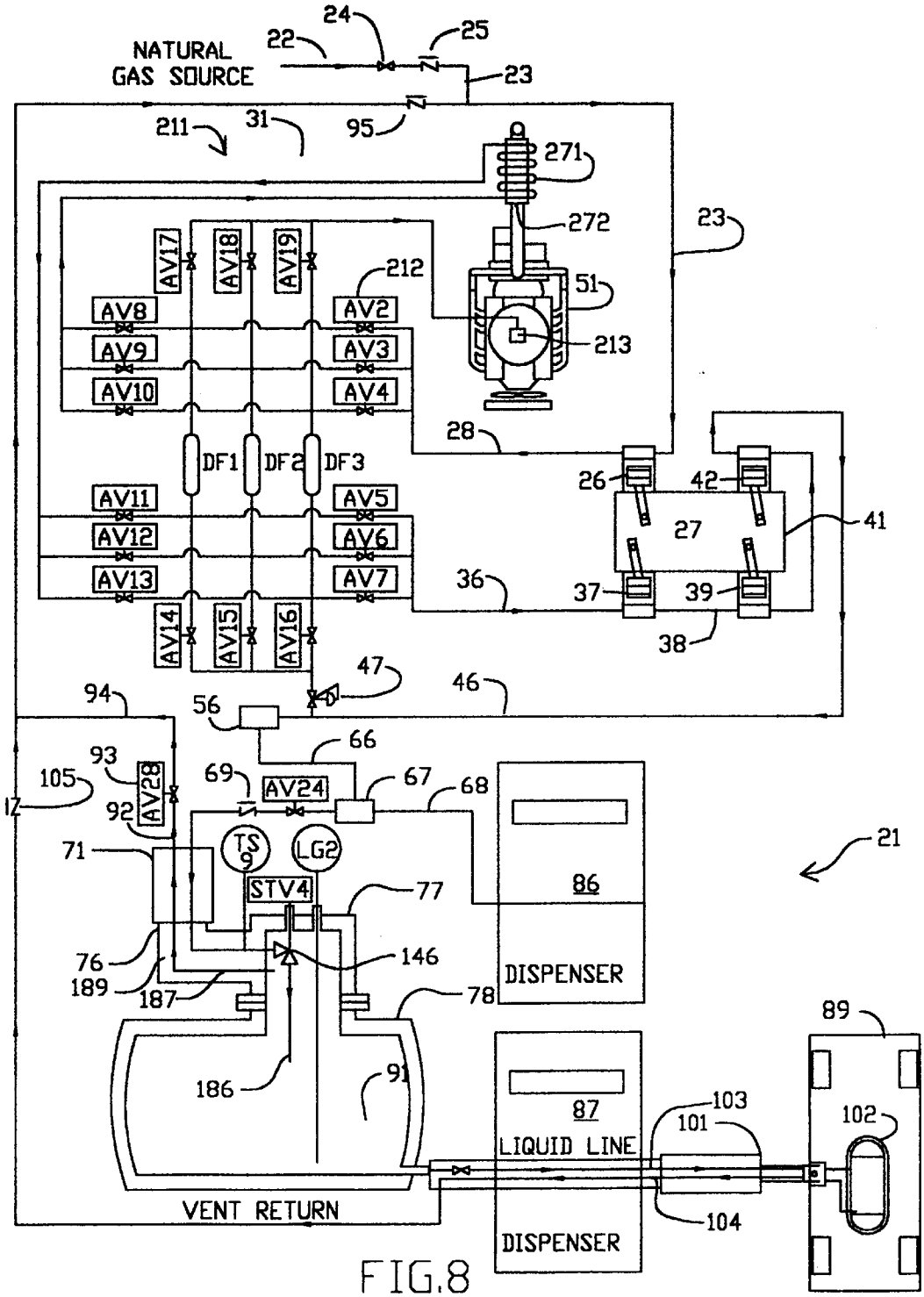
FIG. 8 is a simplified flow diagram of the present invention showing the manner in which the tri-tower regenerating molecular sieve bed is operated to perform the method of the present invention.

The molecular sieve bed 31 hereinbefore identified and which is more particularly shown in FIGS. 4, 5, 6, 7 and 8 consists of the three tanks, towers or filters 32, 33 and 34 and also identified respectively as DF1, DF2 and DF3. As shown in FIGS. 4, 5 and 6, these filters 32, 33 and 34 are interconnected by piping 211 which has provided therein a plurality of air actuated valves 212 bearing an AV designation as hereinafter set forth supplied with air from a conventional electric motor-driven air compressor (not shown). The physical arrangement of this piping 211 with respect to the three vessels or filters 32, 33 and 34 is shown in FIGS. 4, 5 and 8 in a physical format and in FIG. 8 in a diagrammatic format. As shown in FIG. 4, each desiccant filter of the vessels or filters 32, 33 and 34 consists of an outer pressure vessel 221 formed of steel and having a suitable size as for example a diameter of 24" and a height of approximately 8'6". This outer vessel 221 is provided with a cylindrical wall 222 with its open ends being enclosed by a top dome 223 and a bottom dome 224. The outer vessel 221 is supported in a vertical position by a circular support 226 welded to the lower extremity of the cylindrical wall 222. The outer vessel 221 is designed to withstand 150 psi and a temperature of 650° F. with a designed operating range of 0° F. to 550° F.

An inner vessel or liner 231 is disposed within the outer vessel 221 and is formed of a suitable thin-wall material such as 10 gauge stainless steel and has a suitable diameter as for example 16". The inner vessel or liner 231 is provided with a cylindrical wall 232 with a bottom plate 234 enclosing the bottom open end. The top is open to outer pressure vessel 221 so that there is no pressure differential between the anterior of the inner vessel 231 and the interior of the outer vessel 221. Thus the vessel 231 has the thin wall which accelerates heating and cooling of the vessel 231 during operation as hereinafter described. A support 236 is welded between the cylindrical wall 232 and the bottom 224 so that the inner vessel or liner 231 is supported in an upwardly spaced position with respect to the bottom dome 224 and in such a manner so that there is an annular space 241 which is filled with insulation which surrounds the cylindrical wall 232 and the bottom plate 234. Circumferentially spaced-apart liner spacers 242 are only welded to the inner vessel or liner 231. This permits the liner to expand and contract with respect to the outer vessel during operating cycles.

A gas inlet pipe 246 of a suitable diameter such as 1" and forming a part of the piping 211 is mounted in the top dome 223 of the outer vessel 221 for supplying gas to the inner vessel or liner 231. Similarly a gas outlet pipe 247 also of a suitable size such as 1" and forming a part of the piping 211 is connected into the bottom plate 234 of the inner vessel or liner 231.

A plurality of circumferentially spaced-apart grate supports 251 are welded to the interior of the inner vessel 231. A circular grate 252 approximately 15¾" in diameter rests upon the grate supports 251. The circular grate has circular openings 253 of a suitable size of ¼" in diameter with spaced apart centers of ⅜". A plurality of dispersing elements in the form of ceramic balls 256 having various sizes ranging from ⅛" to ½" at a depth of approximately 6" overlie the grate 252. A circular mesh 258 of a suitable diameter such as 16" with the mesh being formed of 20 wires per inch in two orthogonal directions to provide openings 259 of a size of approximately 0.036" square. The space in the inner vessel or liner 231 above the mesh 258 is filled with a suitable desiccant material 261 of a suitable type such as a synthetic sodium potassium compound that absorbs carbon dioxide and water as for example Z402 supplied by Zeochem Corporation of Louisville, Ky. The desiccant material can be identified as a 4A material having a very small particle size similar to that of sand. This desiccant material has a relatively long lifetime as for example 2 to 3 years after which it can be vacuumed out and replaced. A mesh 263 similar to the mesh 258 overlies the top of the desiccant material 261. The mesh 263 is overlaid with ceramic balls 264 similar to the ceramic balls 256 and having a depth of approximately 6".

The piping 211 hereinbefore described in connection with the desiccant towers or filters 32, 33 and 34 and as shown in FIGS. 4 and 8 have relative positions in two stacks as indicated by the two rows of numbers set forth below from 1 to 9 and 10 to 18.

Chart I

| | | | |
|---|---|---|---|
| 1 | AV8 | 10 | AV2 |
| 2 | AV9 | 11 | AV3 |
| 3 | AV10 | 12 | AV4 |
| 4 | AV11 | 13 | AV5 |
| 5 | AV12 | 14 | AV6 |
| 6 | AV13 | 15 | AV7 |
| 7 | AV17 | 16 | AV14 |
| 8 | AV18 | 17 | AV15 |
| 9 | AV19 | 18 | AV16 |

These valves 212 are operated in various sequences in three cases in which in each case has one of the desiccant towers performing filtering, one of them regenerating and the third cooling. These three cases are set forth below:

CHART II

| | | | | |
|---|---|---|---|---|
| Case 1 | DF1 Filtering | DF2 Regenerating | DF3 Cooling | SEQ 3 |
| | Open valves: AV2, AV5, AV10, AV12, AV16, AV18 | | | |
| Case 2 | DF1 Regenerating | DF2 Cooling | DF3 Filtering | SEQ 1 |
| | Open valves: AV4, AV7, AV9, AV11, AV15, AV17 | | | |
| Case 3 | DF1 Cooling | DF2 Filtering | DF3 Regenerating | SEQ 2 |
| | Open valves: AV3, AV6, AV8, AV13, AV14, AV19 | | | |

As can be seen from above, the valves 212 are operated in predetermined sequences as set forth in Sequence 1, Sequence 2 and Sequence 3. The condition of the air valves 212 in each sequence is set forth below:

CHART III

| Valve Sequence 1 changes from: Case 1 to Case 2: | | Valve Sequence 2 changes from: Case 2 to Case 3: | | Valve Sequence 3 changes from: Case 3 to Case 1 | |
|---|---|---|---|---|---|
| 15 | O AV19 | 2 | O AV18 | 6 | O AV17 |
| 10 | C AV12 | 7 | C AV11 | 16 | C AV13 |
| 14 | C AV10 | 1 | C AV9 | 5 | C AV8 |
| 11 | O AV15 | 8 | O AV14 | 17 | O AV16 |
| 15 | C AV19 | 2 | C AV18 | 6 | C AV17 |
| 17 | C AV16 | 11 | C AV15 | 8 | C AV14 |
| 13 | O AV4 | 3 | O AV3 | 4 | O AV2 |
| 18 | O AV7 | 12 | O AV6 | 9 | O AV5 |
| 9 | C AV5 | 18 | C AV7 | 12 | C AV6 |
| 4 | C AV2 | 13 | C AV4 | 3 | C AV3 |
| 6 | O AV17 | 15 | O AV19 | 2 | O AV18 |
| 7 | O AV11 | 16 | O AV13 | 10 | O AV12 |
| 1 | O AV9 | 5 | O AV8 | 14 | O AV10 |
| 2 | C AV18 | 6 | C AV17 | 15 | C AV19 |

O = Open
C = Close
At the end of SEQ 1 valves are left in Case 2
At the end of SEQ 2 valves are left in Case 3
At the end of SEQ 3 valves are left in Case 1
Sequences are initiated when the SEQ buttons are turned from OFF to ON.

The above-identified sequences are initiated under the control of the computer 106. However, sequence buttons (not shown) are provided which can be turned from OFF to ON to manually initiate a sequence.

In connection with the piping 211 there is provided a coil 271 which is wrapped around a muffler 272 provided on the internal combustion engine 51. (See FIG. 8.)

Operation and use of the apparatus 21 for liquefying natural gas and utilizing the method of the present invention may now be briefly described as follows. The overall operation of the apparatus in performing the method has already been set forth in conjunction with the description of the apparatus shown in FIG. 1.

The JT valve assembly 77 which is used in connection with the method of the present invention creates the cryogenic liquid natural gas. It creates it on the top of the dewar 78 and introduces it directly into the top of the inner tank 111 through the pipe 186 while at the same time permitting an expansion and contraction of the inner cryogenic tank 111 with respect to the outer tank 112.

It is the function of the JT valve assembly 77 of the present invention to maintain a constant pressure immediately before the JT valve 144 regardless of the temperature of the gas supplied to the JT valve 144 whereby there is provided a controlled expansion of the gas from the high pressure in the inlet pipe 181 to the lower pressure in the tank 111 of the dewar 78. The lower pressure in the dewar 78 is controlled by an adjustable back pressure regulator 183 (FIG. 1) in piping to provide a running pressure in the dewar ranging from 70 to 125 psi. In connection with the present invention, it is the purpose of the JT valve assembly 77 to optimize the pressure difference across the JT valve 144 to provide the final cooling of the gas which forces it to liquefy. In connection with the present invention it has been found that the optimum results in liquefication have been obtained by utilizing a pressure in the inlet gas to the JT valve 144 at a pressure ranging from 2200 to 3000 psi and preferably from 2700 to 2800 psi. Utilizing such pressures, it has been found that it is possible using the method of the present invention to liquefy approximately 50% or more of the gas stream in each pass through the JT valve 144.

In placing the apparatus 21 of the present invention in operation, it has been found that until the heat exchanger 82 (FIG. 8) is very cold which only occurs after operation for a substantial period of time, the gas being supplied to the inlet 181 is not very cold and therefore the gas is very expansive creating higher pressures in the inlet flow passage 151. It is therefore necessary that the computer 106 programs opening of the JT valve 144 to let more gas pass through the orifice 148 to maintain a constant pressure in the inlet 151 and to prevent the pressure from going too high. As the heat exchanger 71 becomes colder, the gas being supplied to the inlet 151 becomes more dense and the pressure tends to drop. Since a pressure drop is undesirable, the JT valve 144 under the control of the computer is moved to begin closing down of the JT valve 144 by moving the needle valve 152 downwardly to reduce the size of the orifice 148. By controlling this pressure in the inlet 151 it is also possible to control the differential between the inlet pressure and the dewar pressure to thereby maximize the liquefication of the gas passing through the JT valve 144.

It has been found in connection with the present invention that pressures above 3000 psi in the inlet 181 are undesirable because the pressure lines on the methane entropy chart at higher pressures are almost vertical so that there is very little increase in liquefaction with the increase in pressure above 3000 psi. However, with a decrease in pressure, the liquefaction rate drops rather rapidly. Thus in accordance with the present invention it is undesirable to perform liquefaction at pressures below 2200 psi and above 3000 psi with the optimum pressure being 2700 to 2800 psi.

As well known to those skilled in the art, the amount of liquid in the dewar can be readily ascertained by measuring the differential pressure in the liquid from the top of the tank and at the bottom of the tank.

In connection with the present invention it has been found that because the apparatus cannot run continuously it is necessary to ensure that substantially all the carbon dioxide and water have been removed in the early stages of processing of the natural gas in order to prevent freezing in the event of a shutdown of the apparatus which can occur when demand for fuel does not match the rate of production of fuel by the apparatus.

In connection with the operation of the molecular sieve bed 31 as a part of the apparatus 21 it can be seen from FIG. 8 that the gas stream from the first stage 26 of the compressor 27 is supplied to the piping manifold 211 which under the control of the valves 212 can be passed through any one of the three desiccant filters 32, 33 and 34 also identified as DF1, DF2 and DF3. The gas after passing through one of these filters is returned to the input of the second stage of the compressor 27. At the same time, a gas stream from a higher pressure point in the piping is used to cool one of the desiccant filters selected through the valving 212. Thereafter this gas passing from this desiccant filter being cooled is supplied to the coil 271 that is wrapped about the engine muffler 272. This heated gas is then returned to heat a selected desiccant filter for regeneration.

In connection with the present invention it has been found that a single desiccant filter can act as a filter for absorbing carbon dioxide and water for a period of approximately four hours, after which carbon dioxide can be detected as passing from the gas outlet pipe 247 indicating that the desiccant filter is saturated. This condition is sensed by the computer 108 which operates the valves 212 through a sequence to change the order in which the filter is being used and for what. For example, when a desiccant filter has become saturated, the gas which has been heated up to 600° F. by the muffler 272 passes from the bottom of the desiccant filter up towards the top for a period of approximately four hours. During this four-hour period of time most of the carbon dioxide has been removed and loosened from the desiccant filter. That filter with appropriate control of the valving 212 is then supplied with a cooling stream of gas. Within approximately 2½ to 3 hours it is found that the gas coming out of the top of the desiccant filter no longer contains any carbon dioxide. After that has occurred, the desiccant filter is ready to be put back into use for performing another cycle of removing carbon dioxide and water from the natural gas.

The sequencing for operating the valves has been hereinbefore set forth in connection with Charts II and III. When it is found that it is desired to shut the system down either for lack of demand for fuel or for example for overnight when there may be no demand, the desiccant filter which is in a cycle of being heated is typically very rich in carbon dioxide that is still present even though it is not contained in the desiccant within a desiccant filter. Upon cooling, this carbon dioxide which is present within the desiccant filter is reabsorbed back into the desiccant in the desiccant filter making it ineffective when placed back into service. In connection with the apparatus and the method of the present invention, this problem is overcome by running the desiccant stacks at a higher pressure, as, for example, 135 to 145 psi, which is the pressure available after the first stage 26 of the compressor 27. In addition, the desiccant filters that were being regenerated by cooling and heating are emptied of gas by continuing running of the natural gas engine 51 until the pressure in these desiccant filters has dropped to 20 psi or less. By doing so it has been found that it is possible to clear substantially all of the carbon dioxide out of both of the regenerating desiccant filters so that the apparatus can be restarted successfully with all of the desiccant towers functioning in the appropriate manner.

In connection with the present invention it is desirable to control the shutting down of the apparatus to a selected time at which one of the desiccant filter has just been heated.

In connection with the desiccant filters forming the molecular sieve bed 31 it has been found that natural gas flowing at about approximately 250 cubic feet per minute can be accommodated. Typically approximately 0.7% carbon dioxide is in the gas which content can be removed by one of the desiccant filters becoming saturated in approximately four hours of operation. This flow of gas corresponds to the flow of gas supplied to the internal combustion engine 51 which consumes approximately 30 cubic feet per minute representing the heavy hydrocarbons in the natural gas.

The use of three desiccant filters is necessary because it takes two full cycles to regenerate a desiccant filter as by first heating and then cooling, with the heating and cooling taking approximately 5½ to approximately 6½ hours to completely regenerate. This makes it possible to utilize three desiccant filters in three cycles to achieve continuous operation in four hour increments. Another constraint on the apparatus is that the regenerative flow is the only flow that the internal combustion engine can consume. Thus the nitrogen, the carbon dioxide, the water and the oil from the compressor which are all unwanted elements embedded in the natural gas stream are supplied to the internal combustion engine and burned therein and then exhausted to the atmosphere.

It has been found in conjunction with operation of the apparatus it has been possible to cycle the desiccant filters without monitoring the carbon dioxide by conducting the cycling at timed intervals.

With the valve sequencing disclosed herein, the entire apparatus can continue working without stopping the flow of gas to the engine 51 or stopping flow between the first stage and the second stage of the compressor 27 all under the control of the programmed computer 108. Thus in connection with the valving utilized, it is important to appreciate that fuel must be continuously supplied to the internal combustion engine 51 during operation and that there must be a continuous gas path from the first stage of the compressor to the second stage of the compressor. In the valving sequence, it is necessary to take one stack out of the service that it was in, for example a cooling stack can have the gas passing therethrough supplied to the engine. Another stack is brought into parallel and put it in the filtering cycle and then taking the stack that was in a filtering cycle out of service and place it into the heating regeneration cycle. Thus in the valve sequencing, it is always desirable to feed gas to the engine and to safely put a second stack on line into the compressor and then to take the first stack off line from the compressor. Thereafter the stack that was filtering is placed in the heating cycle to complete a sequence.

From the foregoing it can be seen that there has been provided an apparatus and method for liquefying natural gas for vehicular use. The apparatus is an on-site semi-portable liquefier which enables liquid natural gas to become a viable, economical, environmentally clean transportation fuel. Utilizing such fuel it has been found that current design liquid methane gas powered vehicles achieve reduction of 87% of reactive hydrocarbons and 82% of carbon monoxide and virtually eliminate particulate pollution over comparable gasoline and diesel powered vehicles. The method of liquefaction incurs no boil-off or atmospheric increases to the greenhouse effect. Because natural gas has the highest hydrogen-to-carbon ratio of all fuels, other than hydrogen itself, natural gas should remain the dominant alternative transportation fuel until the use of pure hydrogen occurs. The tank of a vehicle can be filled from the apparatus without the use of a cryogenic pump because vapor from the tank is withdrawn by the compressor.

What is claimed:

1. Apparatus for liquefying natural gas supplied from a source of natural gas comprising a compressor for compressing the natural gas, chiller means for reducing the temperature of the compressed gas, a heat exchanger for further cooling the cooled compressed gas, a dewar having compressed natural gas therein at a pressure, a Joule-Thompson valve carried by the dewar and having an inlet and an orifice in communication with the inlet and an adjustable needle movable into and out of the orifice for changing the size of the orifice, inlet piping connecting the heat exchanger to the inlet of the Joule-Thompson valve for supplying cooled compressed gas at a pressure to the inlet of the Joule-Thompson valve, said dewar having a pressure substantially less than the pressure in the inlet whereby when the cooled compressed gas from the inlet piping passes through the Joule-Thompson valve there is an expansion of the gas to cause liquefaction of a substantial portion of the gas as it passes into the dewar and means coupled to the needle for precisely adjusting the position of the needle with respect to the orifice to thereby precisely adjust the size of the orifice to maintain a substantially constant pressure of the cooled compressed gas in the inlet to thereby provide a continuous controlled expansion of the cooled compressed natural gas from a high pressure to the lower pressure in the dewar through the Joule-Thompson valve and independent of the temperature of the gas in the inlet.

2. Apparatus as in claim 1 further including piping means connected between the heat exchanger and the dewar for supplying cooled natural gas from the dewar to the heat exchanger to cause cooling of the natural gas as it passes through the heat exchanger.

3. Apparatus as in claim 1 wherein the pressure at the inlet is maintained at a pressure ranging from 2200 to 3000 psi.

4. Apparatus as in claim 1 wherein the pressure in the inlet is maintained at a pressure of 2700 to 2800 psi.

5. Apparatus for liquefying natural gas supplied from a source of natural gas comprising a compressor for compressing the natural gas, chiller means for reducing the temperature of the compressed gas, a heat exchanger for further cooling the cooled compressed gas, a dewar having compressed natural gas therein at a pressure, a Joule-Thompson valve carried by the dewar and having an inlet and an orifice in communication with the inlet and an adjustable needle movable into and out of the orifice for changing the size of the orifice, piping connecting the heat exchanger to the inlet of the Joule-Thompson valve for supplying cooled compressed gas to the Joule-Thompson valve at a pressure, said dewar having a pressure substantially less than the pressure in the inlet whereby when the cooled compressed gas from the inlet piping passes through the Joule-Thompson valve there is an expansion of the gas to cause liquefaction of a substantial portion of the gas as it passes into the dewar and means coupled to the needle for adjusting the position of the needle with respect to the orifice to thereby adjust the size of the orifice to maintain a substantially constant pressure of the cooled compressed gas in the inlet to thereby provide a controlled expansion of the cooled compressed natural gas from a high pressure to the lower pressure in the dewar, said dewar consisting of an outer tank and an inner tank disposed within the outer tank, said outer and inner tanks having upper sides and being provided with aligned holes extending through the upper sides thereof, a Joule-Thompson valve assembly having a manway mounted in the openings in the outer and inner tanks and permitting expansion and contraction of the inner tank with respect to the outer tank, said Joule-Thompson valve being mounted in the manway.

6. Apparatus as in claim 1 wherein said needle valve is provided with a plurality of threads in excess of ten whereby as the needle valve is rotated, the needle valve is moved between open and closed positions with respect to the orifice.

7. Apparatus as in claim 6 wherein said means for adjusting the size of the orifice includes means for measuring the pressure of the cooled compressed gas at the orifice and control means including a precision stepping motor and a gear train connecting the precision stepper motor to the needle valve for adjusting the position of the needle valve in accordance with the measured pressure.

8. Apparatus as in claim 7 further including means carried by the gear train for indicating when the Joule-Thompson valve is in an open position and when the Joule-Thompson valve is in a closed position.

9. Apparatus as in claim 1 further including means for returning compressed cooled gas from the dewar and supplying it to the heat exchanger for causing cooling of the natural gas as it passes through the heat exchanger.

10. Apparatus as in claim 9 wherein said heat exchanger includes means for directing the flow of the cooled compressed natural gas in one direction and wherein the heat exchanger also includes means for directing the cooled natural gas from the dewar in a countercurrent direction.

11. Apparatus as in claim 1 wherein the piping connecting the heat exchanger to the inlet of the Joule-Thompson valve includes tri-axial piping for connecting the heat exchanger to the Joule-Thompson valve assembly, said tri-axial piping including a centrally disposed pipe for conveying the cooled compressed natural gas from the heat exchanger to the inlet of the Joule-Thompson valve, an outer pipe coaxial with the inner pipe for supplying cooled natural gas from the dewar to the heat exchanger and an evacuated outer annulus surrounding the outer pipe for providing insulation to the outer pipe.

12. Apparatus as in claim 1 wherein said means for removing carbon dioxide from the natural gas includes a compressor having at least first and second pressure stages, first, second and third desiccant filters and piping means including valving connecting the first stage of the compressor to the first, second and third desiccant filters and means for removing gas from the first, second and third desiccant filters after the natural gas is passed through the desiccant filters one at a time and supplying it to the second pressure stage of the compressor.

13. Apparatus as in claim 12 together with means for controlling the valving so that the desiccant filters each successively pass through a filtering cycle, a heating cycle and a cooling cycle.

14. Apparatus for liquefying natural gas supplied from a source of natural gas comprising a compressor for compressing the natural gas, chiller means for reducing the temperature of the compressed gas, a heat exchanger for further cooling the cooled compressed gas, a dewar having compressed natural gas therein at a pressure, a Joule-Thompson valve carried by the dewar and having an inlet and an orifice in communication with the inlet and an adjustable needle movable into and out of the orifice for changing the size of the orifice, piping connecting the heat exchanger to the inlet of the Joule-Thompson valve for supplying cooled compressed gas to the Joule-Thompson valve at a pressure, said dewar having a pressure substantially less than the pressure in the inlet whereby when the cooled compressed gas from the inlet piping passes through the Joule-Thompson valve there is an expansion of the gas to cause liquefaction of a substantial portion of the gas as it passes into the dewar, means coupled to the needle for adjusting the position of the needle with respect to the orifice to thereby adjust the size of the orifice to maintain a substantially constant pressure of the cooled compressed gas in the inlet to thereby provide a controlled expansion of the cooled compressed natural gas from a high pressure to the lower pressure in the dewar and means for removing carbon dioxide from the natural gas including a compressor having at least first and second pressure stages, first, second and third desiccant filters and piping means including valving connecting the first stage of the compressor to the first, second and third desiccant filters and means for removing gas from the first, second and third desiccant filters after the natural gas is passed through the desiccant filters one at a time and supplying it to the second pressure stage of the compressor, a natural gas internal combustion engine for driving the compressor and piping for supplying the carbon dioxide and water removed by the desiccant filters from the natural gas to the fuel inlet of the internal combustion engine.

15. Apparatus as in claim 12 wherein each of said desiccant filters includes an outer tank and an inner tank disposed within the outer tank and providing a space between the inner tank and the outer tank and insulation filling the space between the inner tank and the outer tank, a gas inlet connected to one end of the inner tank and a gas outlet connected to the other end of the inner tank and a desiccant disposed in the inner tank.

16. Apparatus as in claim 15 further including a grate overlying the gas outlet and having a plurality of openings therein, a plurality of dispersive elements overlying the grate and a mesh overlying the dispersive elements and underlying the desiccant.

17. Apparatus as in claim 16 further including a grate overlying the desiccant in the tank and dispersive elements overlying the grate.

18. A method for liquefying natural gas from a source and having carbon dioxide and water therein for use with a dewar and a Joule-Thompson valve mounted on the dewar, the Joule-Thompson valve having an inlet and an orifice in communication with the inlet and with the dewar and a precision needle adjustably positioned in the orifice, comprising the steps of compressing the natural gas to a first pressure, removing the carbon dioxide and water from the natural gas after it has been pressurized to the first pressure, compressing the natural gas to a higher pressure, cooling the natural gas at a higher pressure and adjusting the position of the needle to supply the cooled compressed natural gas at a substantially constant pressure to the inlet of the Joule-Thompson valve to provide a continuous controlled expansion of the compressed natural gas from a high pressure to a lower pressure in the dewar through the Joule-Thompson valve and independent of the temperature of the gas in the inlet.

19. A method as in claim 18 further including the step of sensing the pressure of the cooled compressed gas supplied to the inlet of the Joule-Thompson valve and automatically controlling the size of the orifice of the Joule-Thompson valve in accordance with the sensed pressure.

20. A method as in claim 19 wherein the compressed cooled natural gas is supplied to the inlet of the Joule-Thompson valve at a pressure ranging from 2200 to 3000 psi.

21. A method as in claim 20 wherein the pressure ranges from 2700 to 2800 psi.

22. A method as in claim 19 further including the step of removing cooled natural gas from the dewar and using it to cool the cooled compressed natural gas supplied to the inlet of the Joule-Thompson valve.

23. A method as in claim 22 wherein countercurrent flow is utilized for the cooling gas being supplied from the dewar to create a heat exchange between the countercurrent flow of the cooling gas and the flow of the cooled compressed gas supplied to the inlet of the Joule-Thompson valve.

24. A method for liquefying natural gas by a multi-stage compressor having at least first and second pressure stages, and with the use of first, second and third desiccant filters each having an inlet and outlet comprising the steps of supplying the natural gas after it has been compressed through the first stage of the compressor to the inlets of the first, second and third desiccant filters for removing carbon dioxide and water from the natural gas and supplying the natural gas after it has been passed through the desiccant filters to the second stage of the compressor for additional compression, chilling the compressed gas and liquefying the compressed gas, the method further including providing a gas driven internal combustion engine for driving the compressor and having a fuel inlet and including the step of supplying the carbon dioxide and water removed by the desiccant filters to the fuel inlet of the internal combustion engine.

25. A method as in claim 24 wherein the compressor can be operated continuously.

26. A method as in claim 24 wherein the desiccant filters are operated at a pressure ranging from 135 to 145 psi.

27. A method as in claim 24 wherein the system is shut down after emptying the desiccant towers that are regenerating of gas.

28. A method as in claim 27 wherein the desiccant filters which are in a regenerating cycle are emptied of gas by supplying gas from the desiccant filters in a regenerating cycle to the internal combustion engine until the pressure in the desiccant filters has dropped to approximately 20 psi or less.

29. A method as in claim 28 wherein upon shutdown of the system, the desiccant filters are cleared of carbon dioxide.

* * * * *